US005121692A

United States Patent [19]

DiCarlo

[11] Patent Number: 5,121,692

[45] Date of Patent: Jun. 16, 1992

[54] NON-LETHAL, NON-PENETRATING TRAINING BULLET AND CARTRIDGE WITH IMPACT MARKING CAPABILITY

[76] Inventor: James M. DiCarlo, Katy Park Row, 20880 Park Row, Katy, Tex. 77450

[21] Appl. No.: 395,544

[22] Filed: Aug. 18, 1989

[51] Int. Cl.[5] ..... F42B 5/02

[52] U.S. Cl. ..... 102/439; 102/444; 102/513; 102/522

[58] Field of Search ..... 102/430, 439, 513, 520, 102/464, 465, 467, 502, 521, 522, 523

[56] References Cited

U.S. PATENT DOCUMENTS

| | | | |
|---|---|---|---|
| H114 | 8/1986 | Quintavalle | 102/513 |
| 115,498 | 5/1871 | Milbank | 102/522 |
| 191,243 | 5/1877 | Kinney | 102/464 |
| 2,294,822 | 9/1942 | Albree | 102/464 |
| 3,003,418 | 10/1961 | Young | 102/513 |
| 3,031,966 | 5/1962 | Metzger | 102/513 |
| 3,037,454 | 6/1962 | Young | 102/513 |
| 3,107,615 | 10/1963 | Brady | 102/520 |
| 3,429,263 | 2/1969 | Snyder et al. | 102/513 |
| 3,738,271 | 6/1973 | LaCosta | 102/430 |
| 3,782,286 | 1/1974 | Jones et al. | 102/513 |
| 3,791,303 | 2/1974 | Sweeney et al. | 102/513 |
| 3,911,824 | 7/1975 | Barr et al. | 102/513 |
| 3,967,552 | 7/1976 | Settles et al. | 102/430 |
| 4,083,306 | 4/1978 | Woodring | 102/522 |
| 4,899,660 | 2/1990 | Brighton | 102/513 |

*Primary Examiner*—Harold J. Tudor

[57] ABSTRACT

An extractable, reusable, two piece, plactic cartridge, housing a compression nozzle, chamber and pusher disc, having at one end of cartridge an opening to receive a compressionable, halved, hollow point projectile sleeve which contains a soft, compressionable, liquid marking projectile. A solid pusher disc located inside the cartridge, is secured to the interior wall of the cartridge by an elastic tube. The disc having a flat forward side which makes complete surface area contact with projectile sleeve. The aft side of disc being concaved is seated forward of a thrust port, smaller in diameter than the concaved section of disc. The thrust port is the smaller opening of two openings of a conical shaped compression nozzle, which has four equally spaced channels extending from the thrust port longitudinal to the larger opening which joins a circumferencially identical, partially closed end propellant chamber. The chamber, channels and compression nozzle contain the propellant charge. The primer is located aft of the cartridge.

1 Claim, 2 Drawing Sheets

NON-LETHAL, NON-PENETRATING TRAINING BULLET AND CARTRIDGE WITH IMPACT MARKING CAPABILITY

SUMMARY OF INVENTION

A reusable, plastic cartridge that fires a marking fluid projectile, which is compatible for use in automatic and semi-automatic rifles and pistols, is disclosed. A chamber and compression nozzle containing a propellant charge, restricts and directs the compressionable gases through a thrust port into the center of a dome located in the base of a pusher disc, creating a downward thrust, causing forward movement of pusher disc and projectile and a blow back action to the cartridge. The projectile is encased in a sleeve to assist during the firing sequence and which separates immediately after exits from barrel. On impact, the buffer nose on projectile compresses allowing time for an air plunger, aft of buffer nose, to eject marking fluid out rear and sides of projectile, reducing impact force to target.

BACKGROUND

The military, federal agencies, state agencies and local police departments have experimented with training bullets and other devices, to increase the level of simulated combat, assaults and special tactical responses.

Blank rounds have been used in the past and are in current use. The blank offers the sound and weapon response. The blank will not mark a target, which requires a judge to determine the results of a mock confrontation. This type of judging is speculative and does not allow for individual heroism, which has turned many a battle around.

"Blood" capsules have also been tried. They offer the marking capability lost to the blanks. However, when fired from standard military weapons, they do not produce enough blow back for a recycle of the weapon. When modified for blow back, the capsule has been known to cause blunt impact trauma. An air operated weapon was designed to deliver the capsules. This required the individual to train on a foreign weapon and the distance of projectile travel is short.

Currently, a blank with a laser light is used. The target wears a receiver on his person. When the laser light makes contact with the target, the receiver will alert the target and judges as to the results. The blanks, in conjunction with the aforementioned results, activates the laser light when fires. The laser light is known to splinter off of objects causing false readings. The amount per unit is considerable. Also field medics can not respond to visual impact.

The current invention will eliminate the applicable problems, while with regard to automatic and semi-automatic rifles and pistols, elevate simulated combat, assaults and special tactical response to a new level.

STATEMENT OF OBJECTS

It is the primary object of this invention to fire a non-lethal and non penetrating marking liquid projectile from a cartridge which is fully compatible with the loading, cycling and firing operations of automatic and semi-automatic rifles and pistols.

It is another object of this invention to provide a reasonable distance of travel to the projectile with a reduced propellant charge.

it is a further object of this invention to contain the compressionable gases and direct them for the blow back required for recycle operations.

BRIEF DESCRIPTION OF THE DRAWINGS

Other objects, advantages and novel features of the present invention will become apparent upon consideration of the following detailed description when read in conjunction with the accompanying drawing wherein.

DETAILED DESCRIPTION OF DRAWINGS

Figure 1:
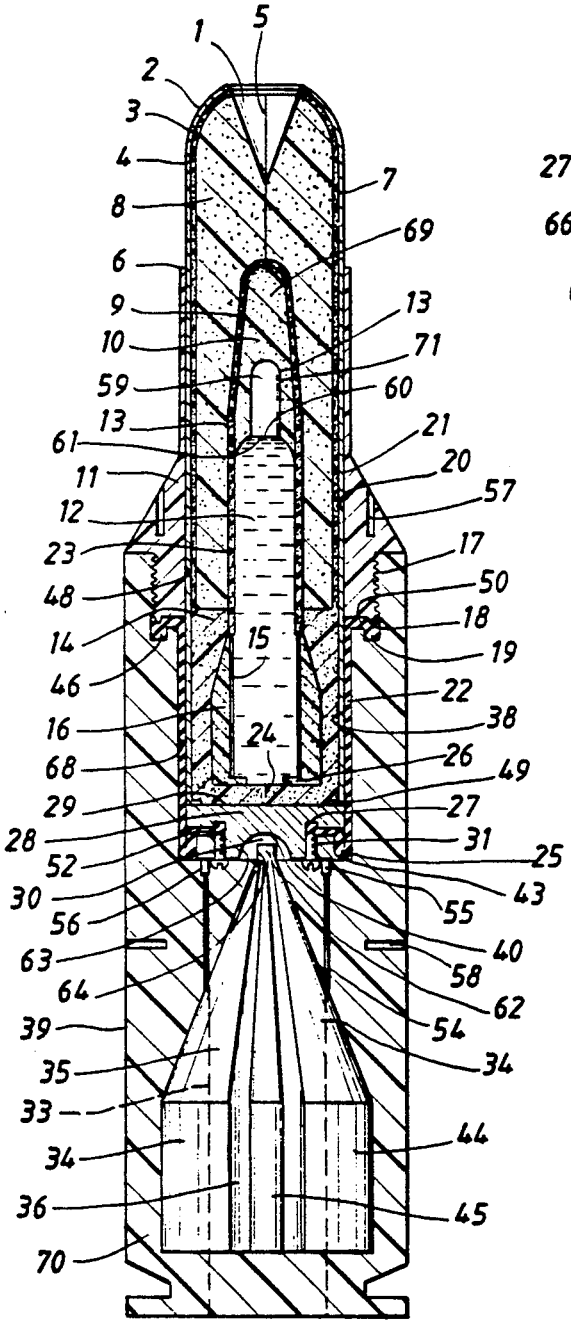
FIG. 1 is a longitudinal section view of an assembled cartridge, projectile and sleeve, embodying the principals of the invention.
Figure 4:
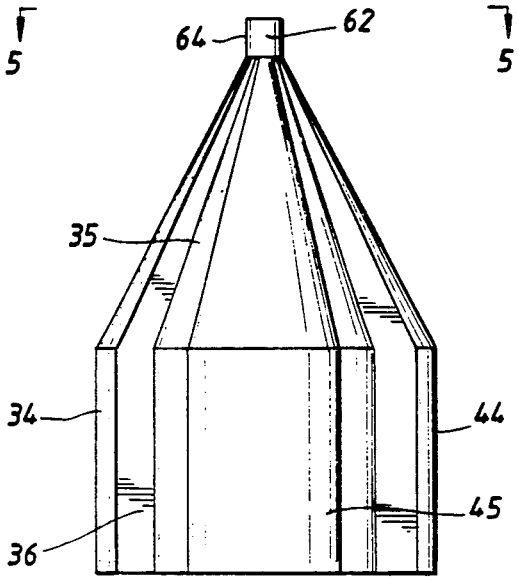
FIG. 4 is a side view of compression nozzle, propellant chamber and thrust port
Figure 6:
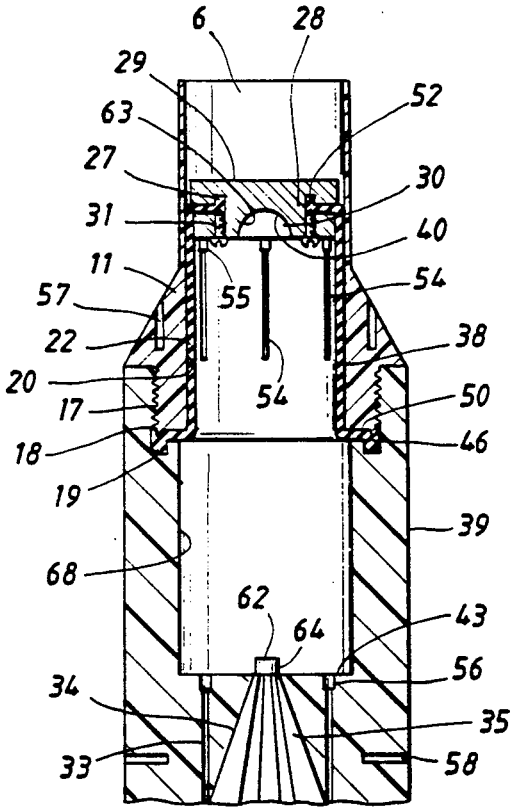
FIG. 6 is a sectional view of cartridge after firing sequence and discharge of projectile and sleeve or the present invention.

The cartridge 70 and projectile 69 shown in FIG. 1, includes a lower case cartridge 39 that as part of mold injection techniques will form as seen in FIG. 4 a propellant chamber 36, compression nozzle 35, thrust port 62, protrusion channels 34, 44 and 45, cont. in FIG. 1, propulsion plug cavities 56, lower case assembly ports 58, threads 17 and tube groove 19 and gas escape ports 33.

Figure 2:
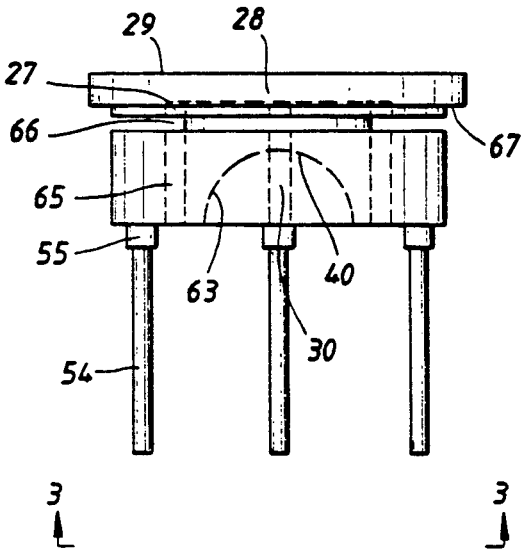
FIG. 2 is a side view with ghost outlines of dome, screw holes and tube groove of pusher disc.
Figure 3:
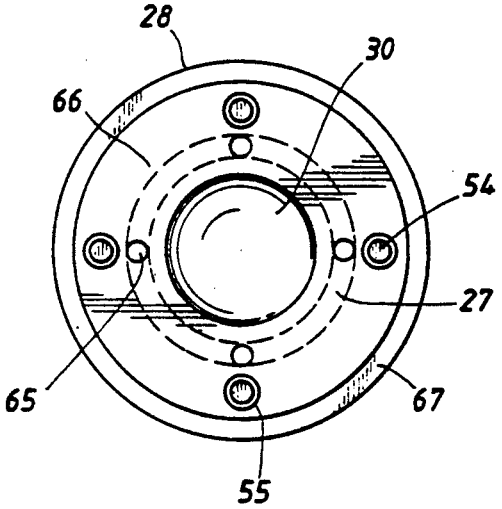
FIG. 3 is a bottom view with ghost outline of tube groove of pusher disc.

The upper case cartridge 11, as part of mold injection techniques will include threads 17, tube notch 18, sleeve opening 6 and upper case assembly ports 57. Method of assembly commences with the secured seating of a conventional impact primer (not pictured) which is located on the aft side of lower case cartridge 39. A propellant charge (not pictured) is dropped through the thrust port 62 and into the propellant chamber 36, filling the propellant chamber 36, protrusion channels 34, 44 & 45 and compression nozzle 35. A pusher disc 28, is first fitted with an elastic tube 22. FIG. 2, the elastic tube 22 is fitted into a tube groove 66 which is secured by allen screws (not shown in FIG. 2) through screw holes 65 wedging the end of elastic tube 22 in disc tube notch 27. Pusher disc 28 is then placed in lower case cartridge 39 with anti-roll bars 54 entering first. Anti-roll bars 54 are aligned and pushed into gas escape ports 33. Proper seating is attained when propulsion plug 55 is secured in propulsion plug cavity 56. Upon proper seating, elastic tube 22 will roll outward from pusher disc 28 and create a pre-set bend 25. Elastic tube 22 will travel forward along interior wall 68 of lower case cartridge 39. The elastic tube 22 is then bent outward to extend over tube groove 19. The upper case cartridge 11 is seated on top of lower case cartridge 39 and screwed down tight with pins (not shown, tool) fitted into upper case assembly ports 57 and lower case assembly ports 58. Upon tightening, a slight twist in elatic tube 22 will be created. Also, the edge of elastic tube 22 will be compressed and wedged in the tube groove 19 creating a casket 50.

The projectile sleeve 7 is split in half as indicated by unsecured seam 5 and attached at sleeve axis 24. The projectile sleeve 7 has a form fitting cavity (not detailed) in both halves that form fit the projectile 69. The projectile 69 is placed in one half of the projectile sleeve 7 cavities. The projectile sleeve 7 is then pushed together to completely encase the projectile 69. Approximately two thirds of the projectile sleeve 7 is dipped into a lubricant 48 to facilitate the seating of projectile sleeve 7 within sleeve opening 6 and exterior elastic wall 38. The projectile sleeve is seated when it rest upon disc top 29. The projectile 69 and cartridge 70 are ready for use.

To further understand the objects, advantages and novel features of the present invention a description of operation is required.

Figure 5:
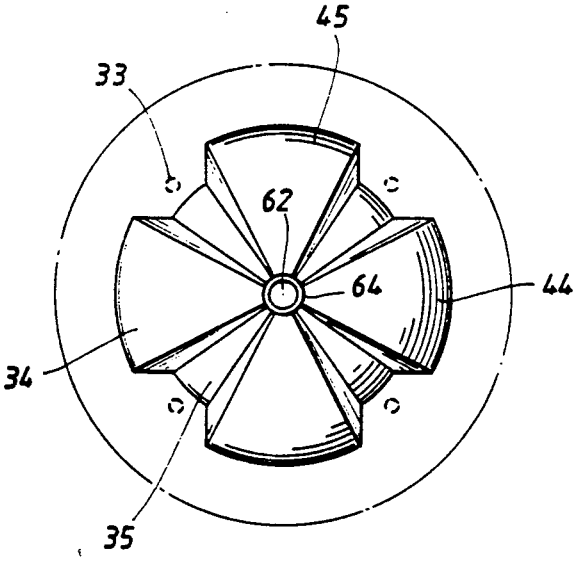
FIG. 5 is a top view of compression nozzle and thrust port with ghost outline of gas escape ports.

Once primer (not pictured) is fired, the propellant charge (not pictured) will ignite inside propellant chamber 36 and protrusion channels 34, 44 and 45 as shown in FIG. 1. Shown in FIG. 5, the protrusion channels 34, 44 and 45 are to allow for additional propellant charge between the gas escape ports 33. Upon initial burning of propellant, the compressionable gases will escape through the thrust port 62, filling dome 30 as shown in FIG. 1. In order to prevent a pre-mature movement of pusher disc 28 and discharge of projectile sleeve 7, propulsion plugs 55, located aft on the pusher disc 28 are secured in propulsion plug cavities 56 which are located in sleeve cavity floor 43, which replace the crimp. The gases will be forced through a smaller diameter opening than the diameter of the propellant chamber 36 as shown in FIG. 4. The compression nozzle 35 maintains at the lower end a diameter equal to that of the propellant chamber 36. The forward opening of compression nozzle 35 narrows to the diameter of the thrust port 62. With the firing pin and weapon chamber (not pictured) securing the primer (not pictured) from being blown out, the compressionable gases are directed through the thrust port 62, thus condensing and accellerating the speed of gas release. The gas will make contact upon the interior ceiling of dome 40, as seen in FIG. 2. The gas will travel along interior dome wall 63, making contact with sleeve cavity floor 43, creating a downward thrust. The thrust and impact of gas on sleeve cavity floor 43 will release propulsion plugs 55 causing forward movement of pusher disc 28 and projectile sleeve 7. The gases will be directed outward of thrust port 62 by a retaining wall 64, thus allowing for uninterrupted flow of compressionable gases to interior ceiling of dome 40. The pusher disc 28 will be traveling at a speed that will not allow gases to fill space between pusher disc 28 and sleeve cavity floor 43, thereby at allowing for uninterupted flow of gas thrust on the pusher disc 28.

As forward movement of pusher disc 28 continues, the elastic tube 22 will roll according to pre-set bend 25. When pusher disc 28 is located near casket 50, the elastic tube 22 will be located primarily below pusher disc 28. To prevent elastic tube 22 from bending and interupting the gas thrust, anti-roll bars 54, attached to aft side of pusher disc 28, which were seated inside gas escape ports 33 and pulled out with forward travel of pusher disc 28, stopping inward movement of elastic tube 22. Once anti-roll bars 54 clear propulsion plug cavities 56, the aforementioned twist in elastice tube 22 will be corrected, off setting alignment of anti-roll bars 54 and gas escape ports 33.

The elastic tube 22 will stretch at end of forward movement of pusher disc 28. Due to stretch, pusher disc 28 will reverse direction, forcing contained compressionable gases rearward and through gas escape ports 33, creating desired force for recycle.

In the event, the compressionable gases are required inside the weapon barrel, (no drawings), the gas escape ports 33 will be closed and titled anti-roll bar tubes 33, the elastic tube 22 will become elastic strips 22 spaced apart and secured in the aforementioned manner, allowing compressionable gases into the barrel.

Due to the materials used in constructing the projectile sleeve 7 and projectile 69, a secure fit within cartridge 70 is essential as shown in FIG. 1. Upon forward movement of pusher disc 28 the projectile sleeve 7 will compress downward and outward allowing for a similar response from the projectile 69. For this reason, in conjunction with the support of the cartridge 70, the lower section of projectile sleeve, the base 14 is made entirely of styrofoam or like material, excluding skin 3, reducing compressionability and inhibiting outward expansion of projectile 69. Above base 14, the styrofoam or like material thins out to form a shell 4, within the shell 4 is a filler 8, made of sponge or like material. The skin 3 is made of tin foil or like material that will after being lubricated 48, will slide in and out of cartridge 70. The skin 3 will also work as a heat shield for the projectile sleeve 7 during the firing sequence and for the heat built up inside the barrel. The skin 3 is rolled and tucked into the base 14 to prevent peeling of skin 3 when being seated into the cartridge 70. While projectile sleeve 7 travels the length of the barrel, a rounded nose 7 will disperse the wind evenly so as to assist in preventing the projectile sleeve 7 from being crushed. The projectile sleeve 7 is of the same diameter as the caliber sized for the weapon, therefore rifling in barrel will induce a spin to the projectile sleeve 7. After projectile sleeve 7 leaves the barrel, wind is forced into the hollow point 1 which separates the projectile sleeve halves along the non-secured seam 5. The projectile sleeve 7 will peel away from the projectile 69. The projectile sleeve 7 is constructed of the aforementioned materials so as to minimize impact to target or bystander that is hit by projectile sleeve 7 before or after separation with projectile 69 is complete.

The projectile 69 is incased in a form fitting cavity within projectile sleeve 7. The projectile 69 has shell 9 made of styrofoam or like material that has a thin wax skin or like material 13 which reduces wind drag. The nose 10 of projectile 69 is make of sponge or like material that houses an air plunger 59. The air plunger 59 is created by lining nose cavity 71 with thin wax or like material skin 13 and placing balloon top 61 at air plunger base 60, then filling balloon 23 with marking liquid 12. The shell 9 thins down on lower half of projectile 69 creating rupture windows 15. The rupture windows 15 extend longitudinal from top of stabilizer fins 16 to balloon retention notch 26, the width being the distance between the stabilizer fins 16. The balloon retention notch 26 is open in the center allowing for the insertion of a deflated balloon 23. The balloon 23 has a rupturable membrane injection port (not shown) that accepts a needle to inject the marking fluid 12. The marking fluid 12 being a heavy liquid will give the projectile 69 the weight required to travel distances. Upon impact on target, the nose 10 and shell 9 will compress, during compression the air plunger 59 forces marking fluid 12 out the rupturable membrane injection part (not shown). As projectile 69 further compresses the rupture windows 15 break away allowing additional marking fluid 12 to escape from the sides. By releasing the marking fluid from the rear and sides of projectile 69, the forward movement of marking fluid 12 is interupted. Coupled with the compressionable material will reduce the impact and injury to target.

I claim:

1. An ammunition round, comprising:

a a cartridge, wherein said cartridge is compatible with automatic and semiautomatic rifles and pistols;

b a projectile sleeve having a first end disposed within said cartridge and a second end extending from said cartridge;

c a projectile disposed within said projectile sleeve;

d means for marking a target disposed within said projectile;

e first means for ejecting said projectile sleeve from said cartridge, said first means comprising:

(i) a propellant chamber carrying a propellant;

(ii) a pusher disk located between said propellant chamber and said projectile sleeve and secured to the interior wall of said cartridge by an elastic tube; and (iii) restraining means sensitive to the expansion of said propellant for restraining the pusher disk until a predetermined amount of propellant is discharged; and f second means for ejecting said projectile from said projectile sleeve subsequent to ejection of said projectile sleeve from said cartridge.

* * * * *

UNITED STATES PATENT AND TRADEMARK OFFICE

CERTIFICATE OF CORRECTION

PATENT NO. : 5,121,692

DATED : June 16, 1992

INVENTOR(S) : James Martin DiCarlo

It is certified that error appears in the above-identified patent and that said Letters Patent is hereby corrected as shown below:

Column 1, line 51, change "fires" to --fired--.

Column 2, line 22, change "or" to --of--.

Column 4, line 27, change "nose 7" to --nose 2--.

Column 4, line 64, change "part" to --port--.

Signed and Sealed this

Eighteenth Day of August, 1992

*Attest:*

DOUGLAS B. COMER

*Attesting Officer*

*Acting Commissioner of Patents and Trademarks*